United States Patent [19]

Spadini et al.

[11] 4,220,562

[45] Sep. 2, 1980

[54] LAUNDRY ADDITIVE PRODUCT

[75] Inventors: Gianfranco L. Spadini, Newcastle upon Tyne; Ian D. Tolliday, Oakham; Allan C. McRitchie, Blyth, all of England

[73] Assignee: The Procter & Gamble Company, Cincinnati, Ohio

[21] Appl. No.: 919,531

[22] Filed: Jun. 26, 1978

[30] Foreign Application Priority Data

Jun. 29, 1977 [GB] United Kingdom ..... 27273/77
Mar. 6, 1978 [GB] United Kingdom ..... 8777/78
Mar. 7, 1978 [GB] United Kingdom ..... 8988/78

[51] Int. Cl.[2] ..... C11D 1/62; C11D 7/32; C11D 17/00

[52] U.S. Cl. ..... 252/542; 252/91; 252/99; 252/102; 252/182; 252/545; 427/242; 428/279

[58] Field of Search ..... 252/8, 6, 10, 90, 95, 99, 252/102, 528, 547, 182, 186, 542, 545, 98; 427/242; 428/260, 265, 279

[56] References Cited

U.S. PATENT DOCUMENTS 3,945,936 3/1976 Lucas et al. ..... 252/95
3,989,638 11/1976 Bradley et al. ..... 252/186

*Primary Examiner*—P.E. Willis, Jr.

[57] ABSTRACT

Additive products are provided for use in the washing of textiles comprising a mixture of an organic peroxy bleach precursor, a cationic surfactant and an alkoxylated nonionic surfactant of HLB 8–17 in water releasable combination with a non-particulate substrate, the additive products being adapted for addition to conventional inorganic persalt-containing detergent liquors to enhance the removal of bleachable and greasy stains.

22 Claims, No Drawings

LAUNDRY ADDITIVE PRODUCT

FIELD OF THE INVENTION

This invention relates to detergent additive products intended for the washing of textiles and especially for the removal of stains from textiles, particularly oxidisable stains and those having an oily or greasy character.

BACKGROUND OF THE INVENTION

In the Applicants' Swedish patent application No. 7711151-6 published on Apr. 6, 1978 there is disclosed a laundry additive product comprising:

(a) a substrate in the form of a non-particulate solid article in water releasable combination with (b) an organic peroxy compound precursor, wherein the weight ratio of the precursor to the substrate lies in the range 90:1 to 1:10.

The above disclosed invention is especially adapted for the removal of oxidisable stains from textiles when used in conjunction with conventional inorganic persalt-containing detergent compositions. It has now been found that certain mixtures of nonionic and cationic surfactants incorporated together with the organic peroxy compound precursor in water releasable combination with a non-particulate substrate provide enhanced removal of a broad range of stains especially greasy and oily stains. The effect is further increased when the additive product is used in conjunction with a conventional heavy duty laundry detergent containing an anionic surfactant and an inorganic persalt.

SUMMARY OF THE INVENTION

Accordingly the present invention provides a laundry additive comprising:

(a) a substrate comprising a non-particulate solid article in water-releasable combination with, (b) an organic peroxy compound precursor wherein the weight ratio of the precursor to the substrate lies in the range from 30:1 to 1:10 and (c) a surfactant system comprising an alkoxylated nonionic surfactant having an HLB in the range 8.0–17.0 and a cationic surfactant having the empirical formula—

$R_m{}^1R^2{}_xY_LZ$ wherein $R^1$ is a hydrophobic organic radical containing alkyl chains, and/or aryl groups and which may also contain ether linkages, ester linkages, or amide linkages and containing a total of from 8 to 20 carbon atoms, m is a number from one to three, and no more than one $R^1$ can have more than 16 carbon atoms when m is 2, or more than 12 carbon atoms when m is 3, $R^2$ is a substituted or unsubstituted alkyl group containing from one to four carbon atoms or a benzyl group provided that not more than one such benzyl group is directly attached to each Y group, x is a number from zero to three, the remainder of any carbon atom positions being filled by hydrogens, Y is selected from the group consisting of

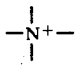

(1)

-continued

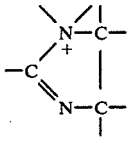

(2)

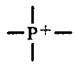

(3)

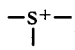

(4)

L is a number from 1 to 4, Z is a water-soluble anion in a number to give electrical neutrality, the cationic surfactant being water dispersible in admixture with the nonionic surfactant, the weight ratio of the nonionic surfactant to the cationic surfactant being in the range 20:1 to 1:2, the weight ratio of the surfactant system to the substrate being in the range 20:1 to 1:5.

As used herein, an organic peroxy compond precursor is any organic compound capable of reaction with an inorganic peroxygen-containing compound in aqueous solution to give an organic peroxy compound having a bleaching performance at a temperature of 70° C. and below, at least equivalent to that of the inorganic peroxygen containing compound under the same conditions.

Also as used herein, the terms inorganic peroxy bleach and inorganic persalt are intended to cover such salts as alkali metal perborates, percarbonates, persilicates and perpyrophosphates which produce hydrogen peroxide in aqueous solution rather than compounds such as persulphates and permanganates which produce other peroxy species.

In a preferred aspect of the present invention, the cationic-nonionic surfactant mixture comprises a mono-$C_{12}$–$C_{14}$ alkyl, tri- $C_1$–$C_4$ alkyl quaternary ammonium salt, particularly the chloride or the methosulphate, and an ethoxylated linear $C_{14}$–$C_{18}$ primary alcohol containing an average of from about 5 to about 30 moles of ethylene oxide per mole of alcohol, the weight ratio of the nonionic to the cationic surfactant being in the range 5:1 to 3:2.

In a further preferred aspect of the invention, the organic peroxy compound precursor of each of the components of a mixture of such precursors is selected from the group consisting of anhydrides, esters, oximes and N-acylated compounds. Preferably the precursor is one or more N-acetylated compounds of structure:

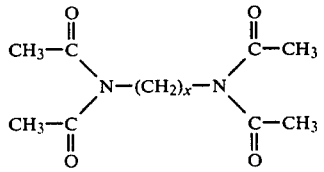

where x can be 0 or any integer between 1 and 6 and is most preferably 0, 2 or 6.

Preferably the substrate is in the form of a flexible sheet wherein the weight ratio of the precursor to the substrate lies in the range 10:1 to 1:10.

In a method aspect of the invention, a method of making a laundry additive product comprises the steps of forming the nonionic-cationic surfactant system and the peroxy compound precursor into a fluid mass, impregnating a solid non-particulate water permeable article with said mass and causing said mass to solidify.

Preferably the combination of the surfactant system and the precursor is mixed with a solid non-hygroscopic organic adjuvant to provide a melt having a viscosity of up to 5000 centipoises at 50° C., this melt constituting a fluid mass with which the substrate is impregnated.

The additive products of the invention are designed to be introduced into the washing machine with the soiled fabrics, or at the beginning of the wash cycle in programmed drum machines.

In accordance with the invention disclosed in Swedish patent application No. 7711151-6, the precursor or mixture thereof is normally added in a separate product to that containing the inorganic peroxy-containing compound although, as described hereinafter, the precursor and the peroxygen-containing compound can be incorporated on a single substrate provided they are physically separated from each other.

Thus, the precursor or mixture of precursors and the inorganic peroxy bleach do not come into contact with each other except in the washing liquor. The delivery of the precursor mixture to the wash liquor in water-releasable combination with a non-particulate solid article avoids most of the stability problems encountered in prior art products and also permits control by the user of whether or not low temperature bleaching is to be employed and the level of bleaching that is to be used. The additive products of the present invention also enhance the human safety of low temperature bleaching of domestic laundry by materially increasing the difficulty of accidental ingestion of the combination.

The products of the present invention also provide an enhanced rate of release for the peroxy compound precursors into the wash liquor relative to that achieved from prior art granular products and this, in turn, improves the rate of conversion into the organic peroxy bleaching species. The disinfectant efficiency of the organic peroxy compounds is thereby improved and the harmful effects of catalase on the bleaching capability of residual inorganic peroxy bleach are reduced.

DETAILED DESCRIPTION OF THE INVENTION

The invention in the broadest form comprises an organic peroxy bleach precursor and a defined cationic-nonionic surfactant system in water-releasable combination with a non-particulate solid substrate.

THE ORGANIC PEROXY COMPOUND PRECURSOR

Organic peroxy compound precursors, or inorganic persalt activators, as they are usually known, are well known in the art and are described extensively in the literature.

In the broadest aspect of the invention, any of the organic peroxy compound precursors described in the above mentioned Swedish patent application No. 7711151-6 can be employed either singly or in combination, but it has been found that where the precursor or mixture of precursors comprises perbenzoic acid generating compounds, combinations thereof with at least one peracetic acid-generating compound in a weight ratio of from 5:1 to 1:5 provide an optimum balance of bleaching and colour safety characteristics.

Thus anhydrides, esters, carbonates, acylated oximes, chloroformates and cyano compounds are all useful classes of organic peroxy compound precursors. N-acylated compounds are also useful, typical examples being the imide, imidazole, sulphonamide and triazine classes and certain acylated hydrazines. Preferred classes of materials are the anhydrides, esters, acylated oximes, imides and acylated hydrazines.

Particularly preferred compounds are N,N,N',N'-tetra acetylated compounds of formula

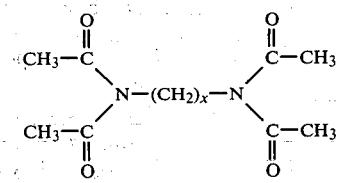

in which x can be 0 or an integer between 1 and 6. Where x is an integer between 1 and 6, the compounds are imides, examples being tetraacetyl methylene diamine (TAMD) where x=1, tetra-acetyl ethylene diamine (TAED) where x=2, and tetraacetyl hexamethylene diamine (TAHD) where x=6. Where x=0 the compound is tetraacetyl hydrazine (TAH). TAHD and TAH are particularly preferred because of their low melting points (59° C. and 83° C. respectively) which facilitates their processing in additive products of the present invention as described hereinafter. All of these compounds and the process for making them are described in British Pat. No. 907,356 the disclosures of which are specifically incorporated herein by reference.

The amount of the peroxy compound precursor or precursor mixture applied to the substrate is arranged such that the precursor:substrate ratio is within the range 30:1 to 1:10 preferably 8:1 to 1:4 and most preferably 5:1 to 1:2 by weight.

The level of usage of organic peroxy compound precursor will naturally be dependent on a number of factors eg. the size of the fabric load in the machine, the level of bleaching performance desired, the amount of inorganic persalt in the conventional detergent products and the usage of the detergent product, the bleaching efficacy of the organic peroxy species derived from the precursor and the efficiency of conversion of the precursor into that peroxy species. It is conventional with inorganic peroxy bleaches to provide a level of available oxygen in solution of from 50 ppm to 350 ppm by weight for heavy duty laundry purposes. However, when using organic peroxy bleaches a level of available oxygen provided by the organic peroxy compound should be in the range 10 ppm to 80 ppm. This level of available oxygen should be attained within the normal wash cycle time ie., within 15 to 25 minutes depending on the particular wash cycle being employed.

For a machine having a liquid capacity in use of 20 to 30 liters, such a level of available oxygen requires the delivery of from 1 gr to 20 gr of organic peroxy compound precursor assuming quantitive conversion. This figure will increase proportionately with any decrease in the efficiency of conversion. Preferably a single unit of substrate should be capable of accommodating this level of precursor and any adjuvants and additives that it is necessary to incorporate into the product although the number of units to be used to deliver a given quantity of precursor is a matter of choice. Normally the weight of precursor per delivery will lie in the range 3 to 10 grs.

THE NONIONIC-CATIONIC SURFACTANT MIXTURE

The grease and oil removal component of the present invention comprises a mixture of a water-soluble, cationic surfactant and an alkoxylated nonionic surfactant of defined HLB range, the weight ratio of the two surfactants being within the range 20:1 to 1:2, preferably 10:1 to 1:1, and most preferably 5:1 to 3:2. The nonionic surfactants used in the compositions may be alkoxylated aliphatic alcohols, alkyl phenols, esters, amides and fatty acids having an HLB within the range 8.0–17.0. The aliphatic alcohols include linear and branched chain primary and secondary $C_8$–$C_{22}$ alcohols, the alkyl phenols are the $C_6$–$C_{12}$ alkyl phenols, and the fatty esters, fatty amides and fatty acids are those having a $C_{12}$–$C_{18}$ alkyl group in the acyl residue. The preferred alkoxylating group is ethylene oxide.

Suitable nonionic surfactants based on alphatic alcohols are condensation products of primary and secondary alcohols with from about 4 to about 30 moles of ethylene oxide. The alkyl chain of the aliphatic alcohol can either be straight or branched and generally contains from about 8 to about 22 carbon atoms. Examples of such ethoxylated alcohols include the condensation product of myristyl alcohol with about 10 moles of ethylene oxide per mole of alcohol and the condensation product of about 9 moles of ethylene oxide with coconut alcohol (a mixture of fatty alcohols with alkyl chains varying in length from 10 to 14 carbon atoms). Examples of commercially available nonionic surfactants of this type include Tergitol 15-S-9, marketed by Union Carbide Corporation, Dobanol 45E9, marketed by Shell Chemical Company, and Kyro EO, marketed by The Procter & Gamble Company. Other suitable alcohol ethoxylates include:

| | |
|---|---|
| Tallow | ($C_{16}$–$C_{18}$) alcohol ($E_{25}$) |
| Linear | ($C_{14}$–$C_{15}$) alcohol ($E_5$) |
| | ($C_{14}$–$C_{15}$) alcohol ($E_7$) |
| | ($C_{12}$–$C_{13}$) alcohol ($E_6$) |
| | ($C_9$–$C_{11}$) alcohol ($E_5$) |
| Branched | ($C_{10}$–$C_{13}$) alcohol ($E_4$) |
| Linear | (s-$C_{11}$–$C_{15}$) alcohol ($E_5$) |
| | (s-$C_{11}$–$C_{15}$) alcohol ($E_7$) |
| | (S-$C_{11}$–$C_{15}$) alcohol ($E_9$) |

Alcohol ethoxylates such as those disclosed in British Pat. No. 1,462,134, incorporated herein by reference, are also useful in the present invention.

Suitable alkyl phenol ethoxylates include the condensation products of alkyl phenols having an alkyl group containing from about 6 to about 12 carbon atoms in either a straight chain or branched chain configuration with ethylene oxide, said ethylene oxide being present in an amount equal to 8 to 20 moles of ethylene oxide per mole of alkyl phenol. The alkyl substituent in such compounds can be derived, for example, from polymerized propylene, di-isobutylene, and the like. Examples of compounds of this type include nonyl phenol condensed with about 9.5 moles of ethylene oxide per mole of nonyl phenol; dodecylphenol condensed with about 12 moles of ethylene oxide per mole of phenol; dinonyl phenol condensed with about 15 moles of ethylene oxide per mole of phenol; and di-isooctyl phenol condensed with about 15 moles of ethylene oxide per mole of phenol. Commercially available nonionic surfactants of this type include Igepal CO-630, marketed by the GAF Corporation, and Triton X-45, X-114, X-100 and X-102, all marketed by the Rohm & Haas Company.

Other suitable phenol ethoxylates include:

| | |
|---|---|
| Linear $C_8$ | Alkyl phenol ($E_5$) |
| $C_8$ | Alkyl phenol ($E_8$) |
| $C_9$ | Alkyl phenol ($E_6$) |
| $C_9$ | Alkyl phenol ($E_9$). |

Suitable fatty acid ethoxylates include coconut fatty acid ($E_5$) and oleic fatty acid ($E_{10}$), while ester ethoxylates include:

| | |
|---|---|
| Sorbitan monooleate | ($E_5$) |
| Sorbitan trioleate | ($E_{20}$) |
| Sorbitan monostearate | ($E_4$) |
| Sorbitan tristearate | ($E_{20}$) |

Other nonionic surfactants useful herein include the condensation products of ethylene oxide with the product resulting from the condensation of propylene oxide with propylene glycol. Surfactants of this type are available commercially from the Wyandotte Chemicals Corporation under the names "Tetronic" and "Pluronic" respectively.

Particularly preferred materials are the primary linear and branched chain primary alcohol ethoxylates, such as $C_{14}$–$C_{15}$ linear alcohols condensed with 7–15 moles of ethylene oxide available from Shell Oil Company under the "Dobanol" Trade Mark and the $C_{10}$–$C_{13}$ branched chain alcohol ethoxylates obtainable from Liquichimica SA under the 'Lial' Trade Mark.

The cationic surfactants used in the compositions of the present invention have the empirical formula—

$R^1{}_mR^2{}_xY_LZ$ wherein each $R^1$ is a hydrophobic organic group containing alkyl chains, alkenyl chains, alkyl benzyl chains, alkyl phenyl chains, ether linkages, alkylene groups, alkenylene groups, ester linkages, and amide linkages totalling from about 8 to 20 carbon atoms and which may additionally contain or be attached to a polyethylene oxide chain containing up to about 20 ethoxy groups, and m is a number from one to three. No more than one $R^1$ in a molecule can have more than 16 carbon atoms when m is 2 and no more than 12 carbon atoms when m is 3. $R^2$ is an alkyl or hydroxyalkyl group containing from 1 to 4 carbon atoms or a benzyl group with no more than one $R^2$ in a molecule being benzyl, and x is a number from 0 to 3. The remainder of any carbon atom positions on the Y group are filled by hydrogens. Y is selected from the group consisting of:

(1)

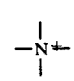

(2)

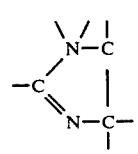

-continued

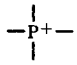

(3)

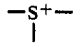

(4)

L is a number from 1 to 4, and Z is a water-soluble anion, such as halide, methylsulfate, hydroxide, or nitrate anion, particularly preferred being chloride, bromide or iodide anions, in a number to give electrical neutrality of the cationic component. The particular cationic component to be included in a given system depends to a large extent upon the particular nonionic component to be used in this system, and is selected such that it is at least water-dispersible, or preferably water-soluble, when mixed with said nonionic surfactant. It is preferred that the cationic component be substantially free of hydrazinium groups. Mixtures of these cationic materials may also be used in the compositions of the present invention.

When used in combination with nonionic surfactants, these cationic components provide excellent soil removal characteristics, confer static control and fabric softening benefits to the laundered fabrics, and inhibit the transfer of dyes among the laundered fabrics in the wash solution.

In preferred cationic materials, L is equal to 1 and Y is:

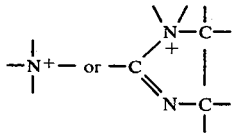

However, L may be greater than 1, such as in cationic components containing 2 or 3 cationic charge centers. Other cationic materials which are useful in the compositions of the present invention include phosphonium, sulfonium, and imidazolinium materials.

Where Y is

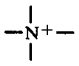

and m=1 it is preferred that x is equal to 3. $R^2$ is typically $C_1$–$C_4$ alkyl, hydroxyalkyl or benzyl(no more than one benzyl group being permissible) but is usually a methyl group. A preferred structure is where one $R^2$ group is hydroxyethyl. Cationic surfactants of this mono long chain type include those in which $R^1$ is a $C_{10}$–$C_{20}$ alkyl group more preferably a $C_{10}$–$C_{16}$ alkyl group or a $C_{10}$–$C_{15}$ alkylbenzyl group. Particularly preferred compositions of this class include $C_{12}$ alkyl trimethyl ammonium bromide, $C_{12}$ alkyl dimethyl hydroxyethyl ammonium bromide, $C_{12}$ alkyl dimethyl hydroxypropyl ammonium bromide, $C_{12}$ alkyl dimethylbenzyl ammonium chloride and their counterparts based on middlecut coconut alcohol as the source of the alkyl group. Other counter ions such as methosulphate, sulphate, sulphonate and carboxylate can also be used particularly with the hydroxyalkyl-substituted compounds.

Specific examples of hydroxyalkyl substituted compounds are the $C_{10}$–$C_{16}$ dimethyl hydroxyethyl ammonium laurates, palmitates, oleates and stearates. These compounds have a waxy physical form and are relatively non-hygroscopic, thereby facilitating their incorporation into the additive products of the invention.

Where m is equal to 2, only one of the $R^1$ chains can be longer than 16 carbon atoms. Thus ditallowdimethylammonium chloride and distearyldimethylammonium chloride, which are used conventionally as fabric softeners and static control agents in detergent compositions, may not be used as the cationic component in the surfactant mixtures of the present invention. Preferred di-long chain cationics of this type include those in which x is equal to 2 and $R^2$ is a methyl group. In this instance it is also preferred that $R^1$ is a $C_8$ to $C_{12}$ alkyl group. Particularly preferred cationic materials of this class include di-$C_8$ alkyldimethylammonium halide and di-$C_{10}$ alkyldimethylammonium halide materials.

Where m is equal to 3, only one of the $R^1$ chains can be greater than 12 carbon atoms in length. The reason for this chain length restriction, as is also the case with the di-long chain cationics described above, is the relative insolubility of these tri- and di-long chain materials. Where tri-long chain alkyl materials are used, it is preferred that $R^2$ is a methyl group. In these compositions it is preferred that $R^1$ is a $C_8$ to $C_{11}$ alkyl group. Particularly preferred tri-long chain cationics include trioctylmethylammonium halide, and tridecylmethylammonium halide.

Cationic surfactants of this type can be prepared by techniques well known to those skilled in the art and which do not form part of the present invention. However a particularly preferred technique the subject of our copending British application No. 8989/78 filed Mar. 1978 and entitled "Process for making detergent compositions" comprises the quaternisation of a tertiary amine in a liquid polyethylene oxide condensate reaction medium which is itself a component of the present invention. The resultant mixture of a cationic surfactant and a polyethylene oxide condensate can be applied directly to the substrate without isolation of the cationic surfactant per se.

The technique involves dissolving or dispering a normally non-volatile tertiary amine, containing one or more long chain hydrocarbon residues, in a nonionic polyethoxylate condensate. A relatively volatile quaternising agent having a boiling point less than 200° C., preferably less than 100° C., and most preferably less than ambient temperature, is reacted with this mixture to form the cationic surfactant. The mixture of cationic surfactant and ethoxylate is normally a dispersion which is solid at ambient temperatures and liquid at temperatures greater than approximately 45° C. but certain preferred hydroxyalkyl group containing quaternary ammonium surfactants having a long chain carboxylate counter ion are miscible with polyethoxylated nonionic surfactants and form clear solutions.

Specific examples of these preferred quaternary ammonium surfactants are myristyl dimethyl hydroxyethyl ammonium stearate, lauryl dimethyl hydroxyethyl ammonium palmitate, and lauryl dimethyl hydroxyethyl ammonium oleate. These compounds are non-crystalline low melting solids having acceptable water solubility together with low hydroscopicity and provide, in combination with nonionic surfactants, enhanced grease and oily stain removal.

Because of their waxy nature and their high affinity for conventional solvents these hydroxyalkyl group-containing quaternary ammonium surfactants are very difficult to prepare in the solvent-free solid state and the above-described technique is a convenient way to obtain them in a form suitable for the purposes of the present invention.

Another useful type of cationic component which is described in U.S. patent application Ser. No. 811218, J. C. Letton, filed June 29, 1977, and incorporated herein by reference, has the formula

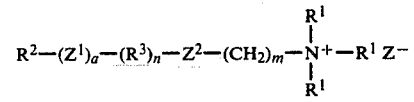

wherein $R^1$ is $C_1$ to $C_4$ alkyl or hydroxyalkyl; $R^2$ is $C_5$ to $C_{30}$ straight or branched chain alkyl or alkenyl, alkyl benzene, or

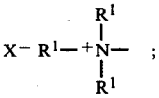

$R^3$ is $C_1$ to $C_{20}$ alkyl or alkenyl; a is 0 or 1; n is 0 or 1; m is from 1 to 5; $Z^1$ and $Z^2$ are each selected from the group consisting of

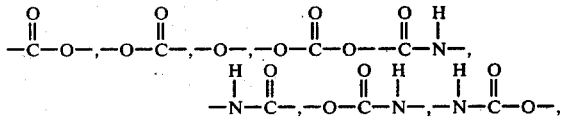

and wherein at least one of said groups is selected from the group consisting of ester, reverse ester, amide and reverse amide; and X is an anion which makes the compound at least water-dispersible, preferably selected from the group consisting of halide, methylsulfate, hydroxide, and nitrate preferably chloride, bromide or iodide.

In addition to the advantages of the other cationic surfactants disclosed herein, this particular cationic component is environmentally desirable, since it is biodegradable, both in terms of its long alkyl chain and its nitrogen-containing segment. These preferred cationic components are useful in nonionic/cationic surfactant mixtures which have a ratio of nonionic to cationic of from about 10:6 to about 20:1. However, when used in the composition of the present invention, they are used in surfactant mixtures which have nonionic to cationic ratios of from about 10:2 to about 10:6, particularly from about 10:3 to 10:5, most preferably about 10:4. These preferred cationic surfactants may also be used in the detergent systems defined in U.S. patent application Ser. No. 811,220 Murphy, filed June 29, 1977 and incorporated herein by reference, in nonionic to cationic ratios of from about 8:1 to 20:1.

Particularly preferred cationic surfactants of this type are the choline ester derivatives having the following formula

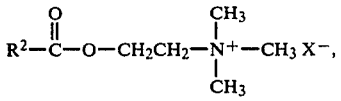

as well as those wherein the ester linkage in the above formula is replaced with a reverse ester, amide or reverse amide linkage.

Particularly preferred examples of this type of cationic surfactant include stearoyl choline ester quaternary ammonium halides ($R^2=C_{17}$ alkyl), palmitoyl choline ester quaternary ammonium halides ($R^2=C_{16}$ alkyl), myristoyl choline ester quaternary ammonium halides ($R^2=C_{13}$ alkyl), lauroyl choline ester ammonium halides ($R^2=C_{11}$ alkyl), and tallowoyl choline ester quaternary ammonium halides ($R^2=C_{16}$–$C_{18}$ alkyl).

Additional preferred cationic components of the choline ester variety are given by the structural formulas below, where p may be from 0 to 20.

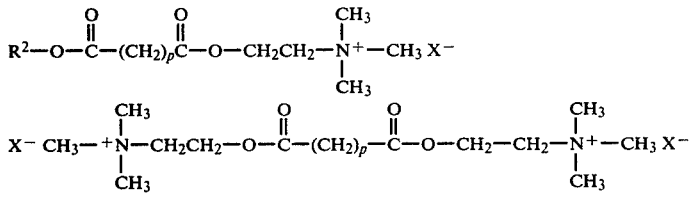

The preferred choline-derivative cationic substances, discussed above, may be prepared by the direct esterification of a fatty acid of the desired chain length with dimethylaminoethanol, in the presence of an acid catalyst. The reaction product is then quaternized with a methyl halide, forming the desired cationic material. The choline-derived cationic materials may also be prepared by the direct esterification of a long chain fatty acid of the desired chain length together with 2-haloethanol, in the presence of an acid catalyst material. The reaction product is then used to quaternize triethanolamine, forming the desired cationic component.

Another type of novel, particularly preferred cationic material, described in U.S. patent application Ser. No. 811219, J. C. Letton, filed June 29, 1977, incorporated herein by reference, are those having the formula

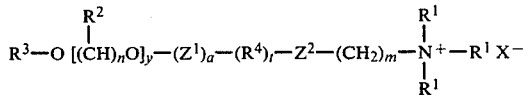

in the above formula, each $R^1$ is a $C_1$ to $C_4$ alkyl or hydroxy-alkyl group, preferably a methyl group. Each $R^2$ is either hydrogen or $C_1$ to $C_3$ alkyl, preferably hydrogen. $R^3$ is a $C_4$ to $C_{30}$ straight or branched chain alkyl, alkenylene, or alkyl benzyl group, preferably a $C_8$ to $C_{18}$ alkyl group, most preferably a $C_{12}$ alkyl group. $R^4$ is a $C_1$ to $C_{10}$ alkylene or alkenylene group. n is from 2 to 4, preferably 2; y is from 1 to 20, preferably from about 1 to 10, most preferably about 7; a may be 0 or 1; t may be 0 or 1; and m is from 1 to 5, preferably 2. $Z^1$ and $Z^2$ are each selected from the group consisting of

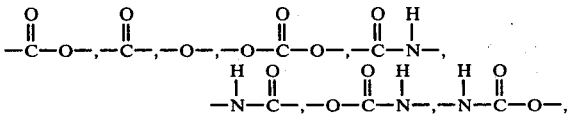

and wherein at least one of said groups is selected from the group consisting of ester, reverse ester, amide and reverse amide. X is an anion which will make the compound at least water-dispersible, and is selected from the group consisting of halides, methylsulfate, hydroxide and nitrate, particularly chloride, bromide and iodide.

These novel cationic surfactants may be used in nonionic/cationic surfactant mixtures in a ratio of nonionic component to cationic component of from about 10:6 to about 20:1. When these surfactants are used in the compositions of the present invention they are used in nonionic to cationic ratios of from about 10:6 to about 10:2. They may also used in the nonionic/cationic surfactant mixtures disclosed in U.S. patent application Ser. No. 811,220, Murphy, filed June 29, 1977 and incorporated herein by reference, wherein the ratio of nonionic component to cationic component would be from about 8:1 to about 20:1. These surfactants, when used in the compositions, of the present invention, yield excellent particulate soil, body soil, and grease and oil soil removal. In addition, the detergent compositions control static and soften the fabrics laundered therewith, and inhibit the transfer of dyes in the washing solution. Further, these novel cationic surfactants are environmentally desirable, since both their long chain alkyl segments and their nitrogen segments are biodegradable.

Preferred embodiments of this type of cationic component are the choline esters ($R^1$ is a methyl group and $Z^2$ is an ester or reverse ester group), particular formulas of which are given below.

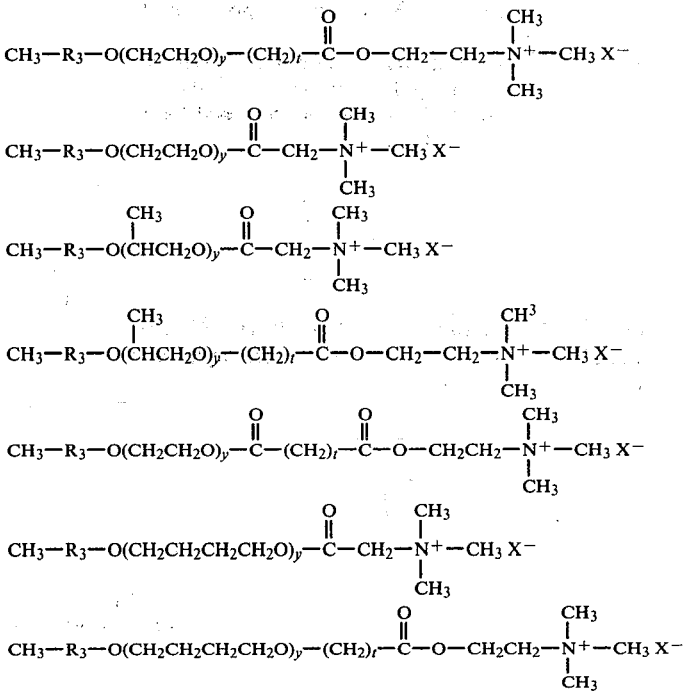

The preferred choline derivatives, described above, may be prepared by the reaction of a long chain alkyl polyalkoxy (preferably polyethoxy) carboxylate, having an alkyl chain of desired length, with oxalyl chloride, to form the corresponding acid chloride. The acid chloride is then reacted with dimethylaminoethanol to form the appropriate amine ester, which is the quaternized with a methyl halide to form the desired choline ester compound. Another way of preparing these compounds is by the direct esterification of the appropriate long chain ethoxylated carboxylic acid together with 2-haloethanol or dimethyl aminoethanol, in the presence of heat and an acid catalyst. The reaction product formed is then quaternized with methylhalide or used to quaternize trimethylamine to form the desired choline ester compound.

The amount of the nonionic-cationic mixture is such that the surfactant mixture:substrate weight ratio lies in the range 20:1 to 1:5, preferably from 10:1 to 1:2, and most preferably from 8:1 to 1:1. In preferred executions using non-woven sheet substrates of approximately 100 sq. ins. plan area and ≈3 grs./sheet basis weight, the loading of nonionic-cationic surfactant mixture is in the range 4–15 grs./sheet.

Where the nonionic-cationic surfactant mixture is a liquid at normal temperatures, its phyical incorporation can take place in a number of ways. Where the substrate comprises a non-sheet like reticulated foam article, direct impregnation of the article by the mixture, either alone or with other components of the formulation can be used, employing methods known in the art and described in more detail hereinafter. Where the substrate comprises a non-woven material or a foam article of sheet-like form, it is preferred to mix the surfactant mixture with a compatible non-hygroscopic material of higher melting point to provide a waxy solid in which the surfactant is present in the form of a solid solution and/or as a dispersed phase. The melting point range and waxy nature of polyethylene glycols of molecular weight >4000 make them useful for this purpose, although their hygroscopicity under extreme conditions of humidity leads to high levels of moisture pick-up if appreciable amounts of such glycols are used. Other useful materials include $C_{12}$–$C_{18}$ fatty acid alkanolamides. However, the preferred materials are the higher fatty acids, particularly the $C_{16}$–$C_{18}$ saturated fatty acids which are employed in an amount such that the weight ratio of fatty acid to nonionic-cationic surfactant mixture is in the range 1:5 to 4:1, preferably 1:3 to 3:2 and most preferably 2:3 to 1:1.

Where the surfactant mixture is a solid at normal temperature but is molten at a temperature less than about 100° C. preferably less than about 80° C., the surfactant mixture itself can be used as the vehicle for incorporating other non liquid components into the substrate. Surfactant mixtures in which the nonionic is a high ethoxylate such as tallow alcohol ($E_{25}$) and $C_{14}$–$C_{15}$ primary alcohol ($E_{15}$) are examples of this type.

Highly preferred surfactant mixtures are those produced by the techniques of cationic surfactant formation in the ethoxylated nonionic surfactant described hereinbefore.

SUBSTRATE

The present invention requires that the peroxy compound precursor be in water-releasable combination with a substrate comprising a non-particulate solid article. The substrate may itself be water soluble or water insoluble and in the latter case it should possess sufficient structural integrity under the conditions of the wash to be recovered from the machine at the end of the laundry cycle. Structures which are water disintegratable ie. that break down in aqueous media to individual fibres or insoluble particles are not considered satisfactory for the purposes of the present invention.

Water soluble materials include certain cellulose ethers, alginates, polyvinyl alcohol and water soluble polyvinyl pyrrolidone polymers, which can be formed into non-woven and woven fibrous structures. Suitable water insoluble materials include, but are not restricted to, natural and synthetic fibres, foams, sponges and films.

The substrate may have any one of a number of physical forms such as sheets, blocks, rings, balls, rods or tubes. Such forms should be amenable to unit usage by the consumer, ie. they should be capable of addition to the washing liquor in measured amounts, such as individual sheets, blocks or balls and unit lengths of rods or tubes. Certain of these substrate types can also be adapted for single or multiple uses, and can be provided with loadings of organic peroxy acid precursor up to a precursor:substrate ratio of 30:1 by weight.

One such article comprises a sponge material releasably enclosing enough organic peroxy compound precursor to provide bleaching action during several washing cycles. This multi-use article can be made by impregnating a sponge ball or block with about 20 grams of the precursor and any adjuncts therewith. In use, the precursor leaches out through the pores of the sponge into the wash liquor and reacts with the inorganic peroxy bleach. Such a filled sponge can be used to treat several loads of fabrics in conventional washing machines, and has the advantage that it can remain in the washer after use.

Other devices and articles that can be adapted for use in dispensing the organic peroxy compound precursor in a washing liquor include those described in Dillarstone, U.S. Pat. No. 3,736,668, issued Jun. 5, 1973: Compa et al, U.S. Pat. No. 3,701,202, issued Oct. 31, 1972: Purgal, U.S. Pat. No. 3,634,947, issued Jan. 18, 1972: Hoeflin, U.S. Pat. No. 3,633,538, issued Jan. 11, 1972 and Rumsey, U.S. Pat. No. 3,435,537 issued Apr. 1, 1969. All of these patents are incorporated herein by reference.

A highly preferred article herein comprises the organic peroxy compound precursor in water-releasable combination with a sheet and this should be flexible so as to make it compatible with the movement of the fabrics in the washing machine and to facilitate its handling during manufacture of the product. Preferably the sheet is water pervious i.e. water can pass from one surface of the sheet to the opposite surface and, for film type substrates, perforation of the sheet is desirable. The most preferred form of the substrate is a sheet of woven or non-woven fabric or a thin sheet of cellular plastic material. Woven fabric sheets can take the form of a plain weave natural or synthetic fibre of low fibre count/unit length, such as is used for surgical dressings, or of the type known as cheese cloth. Loading limitations on non-woven sheet type substrates limit the amount of precursor that can be applied to the sheet, namely to a maximum required by the precursor: sheet weight ratio of about 10:1.

A desirable feature of a substrate to be utilised in the present invention herein is that it be absorbent in nature. It is known that most substances are able to absorb a liquid substance to some degree; however, the term "absorbent", as used herein, is intended to mean a substance with an absorbent capacity (ie. values representing a substrate's ability to take up and retain a liquid) of up to approximately 12 times its weight of water.

Determination of absorbent capacity values is made by using the capacity testing procedures described in U.S. Federal Specification UU-T595b modified as follows:

1. tap water is used instead of distilled water;
2. the specimen is immersed for 30 seconds instead of 3 minutes;
3. draining time is 15 seconds instead of 1 minute; and
4. the specimen is immediately weighed on a torsion balance having a pan with turned-up edges.

Absorbent capacity values are then calculated in accordance with the formula given in said specification. Based on this test, one-ply, dense, bleached paper (eg. kraft or bond having a basis weight of about 32 pounds per 3,000 square feet, has an absorbent capacity of 3.5 to 4; commercially available household one-ply towelling paper has a value of 5 to 6; and commercially available two-ply household towelling paper (a paper structure preferred herein) has a value of 7 to about 9.5.

The substrate of this invention can also be defined in terms of "free space". Free space, also called "void volume", as used herein is intended to mean that space within a structure that is unoccupied. For example, certain multi-ply paper structures comprise plies embossed with protuberances, the ends of which are mated and jointed; such a paper structure has a void volume of free space between the unembossed portion of the plies, as well as between the fibres of the paper sheet itself. A non-woven cloth also had such space between each of its fibres. The free space of non-woven cloth or paper, having designated physical dimensions, can be varied by modifying the density of the fibres of the paper or non-woven cloth. Substances with a high amount of free space generally have low fibre density; high density substrates generally have a low amount of free space. Preferred substrates of the invention herein have up to about 90% free space based on the overall volume of the substrate's structure.

As stated above, suitable materials which can be used as a substrate in the invention herein include, among others, sponges, paper, and woven and non-woven cloth.

A preferred paper substrate is a compressible, laminated, calendered, multi-ply absorbent paper structure. Preferably, the paper structure has 2 or 3 plies and a total basis weight of from 14 to 90 pounds per 3,000 square feet and absorbent capacity values within the range of 7 to 10. Each ply of the preferred paper structure has a basis weight of about 7 to 30 pounds, per 3,000 square feet, and the paper structure can consist of plies having the same or different basis weights. Each ply is preferably made from creped, or otherwise extensible, paper with crepe percentage of about 15% to 40% and a machine direction (MD) tensile and cross-machine (CD) tensile of from about 100 to 1,500 grams per square inch of paper width. The two outer plies of a 3-ply paper structure or each ply of a 2-ply paper structure are embossed with identical repeating patterns consisting of about 16 to 2000 discrete protuberances per square inch, raised to a height of from about 0.010 inch to 0.40 inch above the surface of the unembossed paper sheet. From about 10% to 60% of the paper sheet surface is raised. The distal ends (ie. the ends away from the unembossed paper sheet surface) of the protuberances on each ply are mated and adhesively jointed together, thereby providing a preferred paper structure exhibiting a compressive modulus of from about 200 to 800 inch-grams per cubic inch and Handle-O-Meter (HOM) MD and CD values of from about 10 to 130.

The compressive modulus values which define the compressive deformation characteristics of a paper structure compressively loaded on its opposing surfaces, the HOM values which refer to the stiffness or handle of a paper structure, the MD and CD HOM values which refer to HOM values obtained from paper structure samples tested in a machine and cross-machine direction, the methods of determining these values, the equipment used, and a more detailed disclosure of the paper structure preferred herein, as well as methods of its preparation, can be found in Edward R. Wells, U.S. Pat. No. 3,415,459, issued on Dec. 3, 1968, the full disclosure of which is hereby incorporated hereinto.

The preferred non-woven cloth substrates usable in the invention herein can generally be defined as adhesively bonded fibrous or filamentous products, having a web or carded fibre structure (where the fibre strength is suitable to allow carding) or comprising fibrous mats, in which the fibres or filaments are distributed haphazardly or in random array (ie. an array of fibres in a carded web wherein partial orientation of the fibres is frequently present as well as a completely haphazard distributional orientation) or substantially aligned. The fibres or filaments can be natural (eg. wool, silk, jute, hemp, cotton, linen, sisal, or ramie) or synthetic (eg. rayon, cellulose, or polyesters).

Methods of making non-woven cloths are not a part of this invention and being well known in the art, are not described in detail herein. Generally, such cloths are made by air or water laying processes in which the fibres or filaments are first cut to desired lengths from long strands, passed into a water or air stream, and then deposited onto a screen through which the fibre-laden air or water is passed. The deposited fibres or filaments are then adhesively bonded together, dried, cured and otherwise treated as desired to form the non-woven cloth. Non-woven cloths made of polyesters, polyamides, vinyl resins, and other thermoplastic fibres can be spunbonded, i.e. the fibres are spun out onto a flat-surface and bonded (melted) together by heat or by chemical reactions.

The absorbent properties desired herein are particularly easy to obtain with non-woven cloths and are provided merely by building up the thickness of the cloth, ie. by superimposing a plurality of carded webs or mats to a thickness adequate to obtain the necessary absorbent properties, or by allowing a sufficient thickness of the fibres to deposit on the screen. Any diameter or denier of the fibre (generally up to about 10 denier) can be used, inasmuch as it is the free space between each fibre that makes the thickness of the cloth directly related to the absorbent capacity of the cloth, and which further makes the non-woven cloth especially suitable for impregnation with a peroxy compound precursor by means of intersectional or capillary action. Thus, any thickness necessary to obtain the required absorbent capacity can be used.

The choice of binder-resins used in the manufacture of non-woven cloths can provide substrates possessing a variety of desirable traits. For example, the absorbent capacity of the cloth can be increased, decreased, or regulated by respectively using a hydrophilic binder-resin, a hydrophobic binder-resin or a mixture thereof in the fibre bonding step. Moreover, the hydrophobic binder-resin, when used singly or as the predominant compound of a hydrophobic-hydrophilic mixture, provides non-woven cloths which are especially useful as substrates when the precursor-substrate combinations disclosed herein are used in an automatic washer.

When the substrate herein is a non-woven cloth made from fibres, deposited haphazardly or in random array on the screen, the compositions exhibit excellent strength in all directions and are not prone to tear or separate when used in the washer. Apertured non-woven substrates are also useful for the purpose of the present invention. The apertures, which extend between opposite surfaces of the substrate are normally in a pattern and are formed during laydown of the fibres to produce the substrate. Exemplary apertured non-woven substrates are disclosed in U.S. Pat. Nos. 3,741,724, 3,930,086 and 3,750,237, the disclosures of which are specifically incorporated herein by reference.

Preferably, the non-woven cloth is water-laid or air-laid and is made from cellulosic fibres, particularly from regenerated cellulose or rayon, which are lubricated with standard textile lubricant. Preferably, the fibres are from 3/16" to 2" in length and are from 1.5 to 5 denier (Denier is an internationally recognised unit in yarn measure, corresponding to the weight in grams of a 9,000 meter length of yarn). Preferably, the fibres are at least partially orientated haphazardly, particularly substantially haphazardly, and are adhesively bonded together with hydrophobic or substantially hydrophobic binder-resin, particularly with a nonionic self-crosslinking acrylic polymer or polymers. Conveniently, the cloth comprises about 70% fibre and 30% binder-resin polymer by weight and has a basis weight of from 10 to about 100, preferably 20 to 60 grammes per square yard.

A particularly preferred example is an air-laid non-woven cloth comprising 70% regenerated cellulose (American Viscose Corporation) and 30% hydrophobic binder-resins (Rhoplex HA-8 on one side of the cloth, Rhoplex HA-16 on the other; Rohm & Haas, Inc.). The cloth has a thickness of 4 to 5 mils., a basis weight of about 24 grams per square yard, and an absorbent capacity of 6. One foot length of the cloth 8⅓" wide, weighs about 1.78 grams. The fibres are ¼ in length, 1.5 denier and are orientated substantially haphazardly. The fibres are lubricated with sodium oleate.

A further preferred substrate is a water-laid, non-woven cloth commmercially available from C. H. Dexter Co. Inc. The fibres are regenerated cellulose, about ⅜" in length, about 1.5 denier, and are lubricated with a similar standard textile lubricant. The fibres comprise about 70% of the non-woven cloth by weight and are orientated substantially haphazardly; the binder-resin (HA-8) comprise about 30% by weight of the cloth. The substrate is about 4 mils. thick, and it has a basis weight of about 24 grams per square yard and an absorbent capacity of 5.7. One foot length of the cloth, 8⅓" wide, weights about 1.66 grams.

A further class of substrate material that can be used in the present invention comprises an absorbent foam like material in the form of a sheet. The term 'absorbent foam-like material' is intended to encompass three dimensional absorptive materials such as 'gas blown foams', natural sponges and composite fibrous based structures such as are disclosed in U.S. Pat. Nos. 3,311,115 and 3,430,630 specifically incorporated herein by reference. Synthetic organic polymeric plastics material such as polyether, polyurethane, polyester, polystyrene, polyvinylchloride, nylon, polyethylene and polypropylene are most often employed and a particularly preferred material of this type is a hydrophilic polyurethane foam in which the internal cellular walls of the foam have been broken by reticulation. Foams of this type are described in detail in Dulle U.S. Pat. No. 3,794,029 which is hereby specifically incorporated by reference. A preferred example of this foam type comprises a hydrophilic polyurethane foam of density about 0.596 grs. per cubic inch with a cell count of between 20 and 100 cells per inch, preferably about 60 to 80 per inch available from the Scott Paper Company, Eddystone, Pennsylvania USA, under the Registered Trade Mark "Hydrofoam".

The size and shape of the substrate sheet is a matter of choice and is determined principally by factors associated with the convenience of its use. Thus the sheet should not be so small as to become trapped in the crevices of the machine or the clothes being washed or so large as to be awkward to package and dispense from the container in which it is sold. For the purposes of the present invention sheets ranging in plan area from 20 square inches to 200 square inches are acceptable, the preferred area lying the range of from 80 to 160 square inches for non-woven substrates and 30 to 50 square inches for foamed sheets. Such a size has the additional advantage of being too large to be swallowed by eg. small children, thereby minimising the risk of internal tissue damage from ingestion of the materials absorbed on the substrate.

OPTIONAL COMPONENTS

In addition to the peroxy compound precursors, one or more other materials can be applied to the substrate either separately or together with the precursors, the only constraint on such materials being that the amount that can be incorporated is restricted because of the loading limitations of the substrate. For the substrate types preferred in the present invention the weight of optional component per sheet is unlikely to be more than 10 times the sheet weight, and preferably is less than 5 times the sheet weight, and preferably is less than 5 times the sheet weight.

The principal optional components are solid water soluble or water-dispersible organic adjuvants. These adjuvants can fulfill a variety of functions in the product, such as processing and release aids, specific additives providing performance improvement in the wash cycle and aesthetic ingredients.

One major ingredient can be a processing aid which serves as a plasticiser or thickener in the incorporation of the precursors into or onto the substrate. However, in certain preferred compositions of the present invention, the cationic-nonionic surfactant mixture itself serves as a processing aid as hereinbefore described, and thus little or no additional processing aid is required. Certain other preferred cationic-nonionic mixtures, particularly those wherein the alkoxylated nonionic product is of low HLB, require the use of a thickening adjuvant as described hereinbefore. These adjuvants are solids that are mixed with the precursors and melted to provide mixtures having a viscosity of up to 5000 centipoises at 50° C. Typical solids are polyvinyl pyrrolidone of M.Wt. 44,000–700,000, preferably 500,000–700,000 tallow alcohol ethoxylates containing from 5 to 30 ethylene oxide groups, $C_{12}$–$C_{18}$ fatty acids and certain amides and esters thereof, sorbitan esters of $C_{16}$–$C_{18}$ fatty acids and polyethylene glycols of molecular weight greater than 4,000. As stated hereinbefore, preferred adjuvants are those having low hygroscopicity such as the $C_{16}$–$C_{18}$ saturated fatty acids.

Certain compounds which are themselves peroxy compound precursors, such as methyl o-acetoxy benzoate, polyazelaic polyanhydride of M.Wt. 1,000–2,000 and succinic acid dinitrile, have the required characteristics for use as processing aids and can be employed as such. Paraffin waxes can also be used in minor amounts. Where the processing aid does not have any other function in the product, such as a surfactant component of the grease-removal surfactant mixture, its level of incorporation will be such that the precursor:processing aid weight ratio will be in the range from 20:1 to 1:3, the latter value being for economic reasons. However, the weight ratio of precursor:processing aid can be as low as 1:10 where the processing aid has other functional properties such as surfactancy. A further class of materials useful as a processing aid are the polyacrylamides of molecular weight $\approx$500,000 which are thixotropic water soluble polymers that can retain water in the solid state. The organic peroxy compound precursor can be dissolved or dispersed in an aqueous mull of the polymer. The mull is then fed to the substrate web and deposited to impregnate/coat the substrate whereupon it sets as a solid, but water soluble, gel. This particular class of materials is especially valuable for applying the organic peroxy compound precursors to water soluble substrates such as polyvinyl alcohols which tend to lose their water solubility when exposed to elevated temperatures.

As indicated above, a further type of adjuvant is a release aid that assists in releasing the precursors from the substrate upon addition of the product to a wash liquor. In general, materials serving as processing aids are also suitable as release aids but certain materials, notably stearic acid and polyethylene glycols of M.Wt. 4,000–6,000, are particularly effective when used in amounts such that the weight ratio of precursors:release aid lies in the range 20:1 to 1:2 particularly 4:1 to 1:1. The benefits of the release aid are most clearly seen for water insoluble precursors such as 2,2-di-(4-hydroxyphenyl) propane diacetate.

A further type of release aid is one that is applied to the substrate either during manufacture or prior to the loading of the substrate by the precursor and any other components. Adjuvants of this type are conventionally fluorocarbons or silicone polymers adapted to modify the surface characteristics of the substrate so as to facilitate the removal of the active components on contact with water. Fluorocarbon treating solutions identified as FC 807 and 808 and available from the 3M Company, Minneapolis, Minnesota, provide improved release when applied in amounts such that the weight ratio of substrate-fluorocarbon solids lies in the range 500:1 to 50:1, preferably about 300:1.

In addition to the foregoing optional components, detergent ingredients other than inorganic bleaches can also be incorporated. Thus, surfactants, in addition to the nonionic-cationic mixtures specified hereinbefore, suds modifiers, chelating agents, anti-redeposition and soil suspending agents, optional brighteners, bactericides, anti-tarnish agents, enzymatic materials, fabric softeners, antistatic agents, perfumes and bleach catalysts can all be introduced into a wash liquor by means of the additive products of the present invention, subject to the constraints imposed by the loading limitations of the substrate.

The surfactant can by any one or more surface active agents selected from anionic, zwitterionic, non-alkoxylated nonionic and amphoteric classes and mixtures thereof. Specific examples of each of these classes of compounds are disclosed in Laughlin & Heuring U.S. Pat. No. 3,929,678 issued Dec. 30, 1975, which is hereby specifically incorporated herein by reference.

The optional surfactants can be incorporated at levels such that the optional surfactant:substrate ratio is less than 10:1.

Other optional ingredients include suds modifiers which can be of the suds boosting, suds stabilising or suds suppressing type. Examples of the first type include the $C_{12}$–$C_{18}$ fatty acid amides and alkanolamides, the second type is exemplified by the $C_{12}$–$C_{16}$ alkyl dilower alkyl amine oxides and the third type by $C_{20}$–$C_{24}$ fatty acids, certain ethylene oxide-propylene oxide copolymers such as the "Pluronic" series, silicones, silica-silicone blends, micro-crystalline waxes, triazines and mixtures of any of the foregoing.

Preferred suds suppressing additives are described in U.S. Pat. No. 3,933,672 issued Jan. 20, 1976, Bartolotta et al., incorporated herein by reference, relative to a silicone suds controlling agent. The silicone material can be represented by alkylated polysiloxane materials such as silica aerogels and xerogels and hydrophobic silicas of various types. The silicone material can be described as siloxane having the formula:

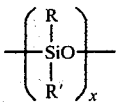

wherein x is from about 20 to about 2,000, and R and R′ are each alkyl or aryl groups, especially methyl, ethyl, propyl, butyl and phenyl. The polydimethylsiloxanes (R and R′ are methyl) having a molecular weight within the range of from about 200 to about 200,000, and higher, are all useful as suds controlling agents. Additional suitable silicone materials wherein the side chain groups R and R′ are alkyl, aryl, or mixed alkyl and aryl hydrocarbyl groups exhibit useful suds controlling properties. Examples of the like ingredients include diethyl-, dipropyl-, dibutyl-, methyl-, ethyl-, phenylmethyl- polysiloxanes and the like. Additional useful silicone suds controlling agents can be represented by a mixture of an alkylated siloxane, as referred to hereinbefore, and solid silica. Such mixtures are prepared by affixing the silicone to the surface of the solid silica. A preferred silicone suds controlling agent is represented by a hydrophobic silanated (most preferably trimethylsilanated) silica having a particle size in the range from about 10 millimicrons to 20 millimicrons and a specific surface area above about 50 $m^2$/gm. intimately admixed with dimethyl silicone fluid having a molecular weight in the range from about 500 to about 200,000 at a weight ratio of silicone to silanated silica of from about 19:1 to about 1:2. The silicone suds suppressing agent is advantageously releasably incorporated in a water-soluble or water-dispersible, substantially non-surface-active detergent-impermeable carrier.

Particularly useful suds suppressors are the self-emulsifying silicone suds suppressors, described in German patent application DTOS No. 2646217, Gault et al, published Apr. 28, 1977, incorporated herein by reference. An example of such a compound is DC-544, commercially available from Dow Corning, which is a siloxane/glycol copolymer.

A preferred mode of incorporation of the silicone suds suppressors is as a separately impregnated area on the substrate, e.g. as a stripe on sheet-type substrates formed from continuous lengths of substrate material.

Suds modifiers as described above are incorporated at levels of up to approximately 5%, preferably from 0.1 to 2% by weight of the cationic-nonionic surfactant mixture.

Chelating agents that can be incorporated include citric acid, nitrilotriacetic and ethylene diamine tetra acetic acids and their salts, organic phosphonate derivatives such as those disclosed in Diehl U.S. Pat. No. 3,213,030 issued Oct. 19, 1965, by Roy U.S. Pat. No. 3,433,021 issued Jan. 14, 1968, Gedge U.S. Pat. No. 3,292,121 issued Jan. 9, 1969, Bersworth U.S. Pat. No. 2,599,807 issued June 10, 1952, and carboxylic acid builders such as those disclosed in Diehl U.S. Pat. No. 3,308,067 issued Mar. 7, 1967, all of the foregoing patents being hereby incorporated herein by reference. Preferred chelating agents include nitrilotriacetic acid (NTA), nitrilotrimethylene phosphonic acid (NTMP), ethylene diamine tetra methylene phosphonic acid (EDTMP) and diethylene triamine penta methylene phosphonic acid (DETPMP), and the chelating agents are incorporated in amounts such that the substrate-chelating agent weight ratio lies in the range 20:1 to 1:5, preferably 5:1 to 1:5 and most preferably 3:1 to 1:1. Certain polybasic acids have been found to enhance the bleaching effect of organic peroxyacids produced when the products of the present invention are useful with conventional detergent composition, examples being EDTMP, NTMP and DETPMP. However, not all chelating polybasic acids are useful in this respect, while certain non-chelating polybasic acids, particularly succinic acid, do show efficacy.

Any of the conventional soil suspending and anti-redeposition agents can be included as optional components, examples being carboxymethyl cellulose and its derivatives and high M.Wt. copolymers of maleic anhydride with methylvinyl ether or ethylene.

A wide range of fabric softeners and antistatic agents can be included as optional compounds. Exemplary cationic nitrogen compounds include the di- $C_{16}$–$C_{18}$ alkyl, di- $C_1$–$C_4$ alkyl quaternary ammonium salts, imidazolinium salts and non-nitrogenous materials such as the sorbitan esters of $C_{16}$–$C_{18}$ fatty acids. A preferred fabric softening and antistatic composition suitable for incorporation into additive products of the present invention is disclosed in U.S. Pat. No. 3,936,537 issued Feb. 3, 1976 to R. Baskerville & F. G. Schiro. Compounds of this type are disclosed in German patent application OLS No. 2,516,104 published Oct. 30, 1975, specifically incorporated herein by reference.

Preferred enzymatic materials include the commercially available amylases, and neutral and alkaline proteases conventionally incorporated into detergent compositions. Because of their heat sensitivity, these materials require incorporation at or close to ambient temperatures and thus addition to a melt of the precursor and other additives is not possible. Accordingly enzymatic materials are best applied in processes utilising solvent or slurry application of the precursor to the substrate.

Catalysts of use herein are those that enhance the effect of the bleaching species. Examples of such materials are the salts of transition metals of atomic number lying between 24 and 29, utilised in conjunction with a chelating agent. Woods U.S. Pat. No. 3,532,634 issued Oct. 6, 1970 and specifically incorporated herein by reference discloses perborate bleach compositions containing an organic peroxy bleach precursor and catalytic compounds of this type.

The compositions herein comprise a precursor together with a nonionic-cationic surfactant mixture and optionally other ingredients in water-releasable combination with a solid non-particulate substrate. Preferably the substrate is absorbent and the materials are impregnated therein. Application of the materials can be carried out in any convenient manner, and many methods are known in the art. For example, where the materials are in liquid form they can by sprayed onto a substrate as it is manufactured. Where the precursor is in liquid form, this can be a melt, and it is highly preferable that the precursors melt at a temperature below that at which they decompose on being heated. Where the precursor is a solid at normal temperatures, alternative liquid forms can be used such as solution in organic solvents which are volatilised after application, and slurries or suspensions of the finely divided solid in water or other liquid media, such as the surfactant mixture.

As previously indicated, inorganic peroxy bleaches and other materials reactive towards organic peroxy compound precursors can be incorporated in the additive products of the present invention provided that the precursor and the bleach (or other material) are spatially separated from each other.

In those embodiments in which the precursor and the inorganic peroxygen bleach are incorporated in physically separate locations on the same substrate, a convenient method of application is the deposition of the respective melts, suspensions or solutions as discrete bands of material on the substrate. Preferably the bleach is applied as a dispersion of solid particles in a molten processing aid (as hereinbefore described) at a temperature in the range 40° to 60° C. Using this technique, bleach-substrate weight ratios of up to 15:1 can be obtained. This level of loading is attainable with cellular substrates but substrates of fibrous character are limited in practice to weight ratios of about 5:1. Furthermore, loading limitations imposed by the substrate surface area required for the incorporation of the precursor may limit the amount of bleach to less than 6:1. Provision must also be made for the separation of the bands or areas of bleach and the corresponding bands or areas of precursor during transport and/or storage. This is achieved by interposing layers of material between the layers of substrate or by producing patterns of deposited material that are not coincident on stacking of the substrate.

Where the substrate is impregnated, it is believed that the surfaces of the pores or fibres making up the substrate are themselves coated and it is a highly desirable aspect of the substrate that it permits an extensive coating of the peroxy compound precursor to be formed. The term "coating" connotes the adjoining of one substrate to the surface of another; "impregnation" is intended to mean the permeation of the entire substrate structure, internally as well as externally. One factor affecting a given substrate's absorbent capacity is its free space. Accordingly, when a precursor is applied to an absorbent substrate, it penetrates into the free space, hence the substrate is deemed impregnated. The free space in a substrate of low absorbency, such as a one-ply kraft or bond paper, is very limited; such a substrate is, therefore, termed "dense". Thus, while a small portion of the precursor penetrates into the limited free space available in a dense substrate, a rather substantial balance of the precursor does not penetrate and remains on the surface of the substrate so that it is deemed a coating.

In one method of making an impregnated sheet-like substrate, the impregnating mixture is applied to absorbent paper or non-woven cloth by a method generally known as padding. The mixture is preferably applied in liquid form to the substrate and precursors and other ingredients which are normally solid at room temperature should first be melted and/or solvent-treated. Methods of melting the ingredients and/or treating with a solvent are known and can easily be carried out to provide a satisfactorily treated substrate.

In this method, the mixture of precursor, surfactants etc. in liquid form, is placed into a pan or trough which can be heated, if necessary, to maintain the contents in liquid form. To the liquid mixture is then added any further additive. A roll of absorbent substrate is then set up on an apparatus so that it can unroll freely. As the substrate unrolls, it travels downwardly and, submersed, passes through the pan or trough containing the liquid mixture at a slow enough speed to allow sufficient impregnation. The absorbent substrate then travels, at the same speed, upwardly and through a pair of rollers which squeeze off excess bath liquid. The impregnated substrate is then cooled to room temperature, after which it can be folded, cut or perforated at uniform lengths, and subsequently packaged and/or used.

The rollers used resemble "squeeze rolls" used by those in the paper and paper-making art; they can be made of hard rubber or steel. Preferably, the rollers are adjustable, so that the orifice between their respective surfaces can be regulated to control the amount of the liquid on the substrate.

In an exemplary execution of the invention, the precursor and other ingredients in liquid form, is sprayed onto absorbent substrate as it unrolls. The unrolled substrate web is arranged to slide over the spray nozzle which comprises a horizontally disposed tube formed with a slit extending along its top surface. The molten slurry of organic peroxy compound precursor surfactant mixture and any additives mixed therewith is forced through the slit into the substrate and the excess liquid is then squeezed off by the use of squeeze rollers. A melt temperature in the range of 40°-80° C. preferably 45°-65° C. is used and the molten material should have a viscosity of less than 5000 centipoises at 50° C., preferably no more than 500 centipoises.

Other variations include the use of metal "nip" rollers onto the leading or entering surfaces of which the impregnating mixture is sprayed, which variation allows the absorbent paper to be treated, usually on one side only, just prior to passing between the rollers wherein excess liquid is squeezed off. This variation additionally involves the use of metal rollers which can be heated to maintain the impregnating mixture as a liquid. A further method involves separately treating a desired number of the individual plies of a multi-ply paper and subsequently adhesively joining the plies with a known adhesive-joiner compound; this provides a composition which can be treated on one of its outer sides, yet contains several other plies, each of which is treated on both sides.

The above techniques can be employed with any of the compositions of the present invention but it has been found that for those systems containing suspended solids some modifications are desirable in order to prevent segregation of the solids in the melt over long periods and also to prevent build-up of the solid components on the surface of the equipment.

In the modified process for handling a suspension of solids in a melt the suspension in the form of a uniform dispersion is fed into a v-shaped trough formed by the generally upright portion of the face of a heated, rotating horizontal roll and a plate inclined thereto so as to leave a small clearance between the bottom of the plate and the roll face. A thin coating of suspension is carried downwards through the clearance and is transferred to a second horizontal roll in contact with the first but rotating in the opposite direction. This second roll is in contact with a continuously advancing web of substrate material and its direction of rotation is such as to make its direction of movement opposite to that of the substrate at the point of contact. Under these conditions the coating on the roll transfers to the substrate and impregnates it without any build up of the suspended solids occurring on the roll. In order to ensure uniform distribution of the molten suspension the impregnated substrate is preferably passed over one or more further counter rotating rolls that serve to spread the suspension evenly over the substrate before it is cooled in an air stream to solidify the impregnating material.

In order to provide a mixture having suitable characteristics ie solidification over a range of temperature to give a waxy rather than a crystalline solid, certain of the precursors suitable for the purposes of the invention need to be blended with a plasticising or thickening agent. For this purpose the peroxy compound precursors can be divided into three different types, namely:

(a) those that are liquid at temperatures up to 25° C. or are solids melting between 25° C. and 40° C.
(b) solids melting between 40° C. and 95° C.,
(c) solids melting above 95° C.

In the high melting solid group it is preferred that the melting point be less than 150° C. although materials having melting points up to 250° C. can be processed by handling as a dispersion in a melt of another material. Of course it should be appreciated that the organic peroxy compound precursor should not decompose to any substantial extent at temperatures below its melting point.

Melting points of a number of peroxyacid precursors suitable for use in the present invention are shown in the table below:

| MATERIAL | MPT |
|---|---|
| N-acetyl caprolactam | Liq |
| N-methyl diacetamide | Liq |
| Acetic anhydride | Liq |
| Benzoyl imidazole | Liq |
| Ethyl o-acetoxy benzoate | Liq |
| Benzyl o-acetoxy benzoate | 25° C. |
| Benzoic anhydride | 40° C. |
| Methyl o-acetoxy benzoate | 49° C. |
| p-acetoxy acetophenone | 52° C. |
| Polyazelaic polyanhydride | 55° C. |
| Succinic acid dinitrile | 55° C. |
| Tetra acetyl hexamethylene diamine | 59° C. |
| 2,2-di-(4-hydroxyphenyl) propane diacetate | 79° C. |
| 1-cyclo hexyl, 3-acetyl hydantoin | 86° C. |
| Tetra acetyl methylene diamine | 94° C. |
| Phenyl o-acetoxy benzoate | 97° C. |
| N-acetyl imidazole | 102° C. |
| Diacetyl dimethyl glyoxime | 112° C. |
| Triacetyl guanidine | 112° C. |
| o-acetoxy benzoic acid | 135° C. |
| 1-phenyl 3 acetyl hydantoin | 147° C. |
| Tetra acetyl ethylene diamine | 148° C. |
| Tetra acetyl glycouril | 237° C. |
| Sodium Acetylphenol sulphonate | Very High |

For the high and low melting point types a water soluble or dispersible organic adjuvant is required that has a range of temperature over which it melts, the adjuvant serving to provide a matrix of acceptable physical properties when impregnated on a non particulate substrate, together with acceptable viscosity temperature characteristics to facilitate impregnation itself. It should also be non-hygroscopic. The adjuvant can be a single material or more commonly a mixture of materials whose overall physical properties are satisfactory. Materials that fall into this category include the long chain fatty acids and their water-soluble or water dispersible esters, certain nonionic ethoxylates such as tallow alcohol ethoxylates having more than 10 ethylene oxide groups per mole of alcohol and high molecular weight polyethylene glycols. Certain mixtures of cationic and nonionic surfactants, notably those incorporating a quaternary ammonium surfactant bearing a long chain carboxylate counter ion, have also been found to be satisfactory components of the water soluble adjuvant.

As indicated above, the adjuvant:precursor weight ratio can have a value of up to 10:1 but may be limited to values less than this by substrate loading constraints.

For precursor materials melting in the optimum range ie. 40° C.–80° C. an organic adjuvant is not essential as a processing aid in the preferred method of manufacture of products in accordance with the invention. Such materials can be melted and applied directly to the substrate and indeed may be used as carriers themselves for other components of the products such as solid chelating agents or liquid nonionic surfactants. However adjuvants of a waxy character may still be utilised in order to provide robustness to the process, for example by reducing dust, to ensure a rapid rate of release and dissolution of the precursor in aqueous media, and/or to modify the surface characteristics of the treated substrate.

In use, the additive products of the present invention are introduced into the washing liquor at a point in the washing process where formation of an organic peroxy bleaching species is of most value. In practice optimum results are obtained, irrespective of the washing cycle being employed, when the additive products of the present invention are fed into the machine at the same time as the fabric load. For machines including a prewash cycle, addition of the additive product at the beginning of the main wash cycle is preferred.

The invention is illustrated in the following nonlimitative examples in which parts and percentages are by weight unless otherwise specified. Reference herein to a test method for assessing the efficacy of peroxy compound precursors in forming organic peroxy bleaching species is to the procedure as set out below.

Activator Perhydrolysis Test 1 m. Mole of the peroxy compound precursor* is added to a stirred solution of sodium perborate tetrahydrate (0.9 gram) sodium pyrophosphate decahydrate (1.25 grams) EDTA (35 ppm) and 0.25 g. sodium tetrapropylene benzene sulphonate in 500 mls of distilled water maintained at 25° C. by a circulating water bath and stirred mechanically.

*Water soluble precursors can be added directly. Other materials can be predissolved in 10 mls of a suitable solvent which will not react with the species present e.g. 1,4 dioxan. In such cases the volume of distilled water should be reduced to 490 mls.

Within twenty minutes of the addition of the precursor at least one 10 ml aliquot is withdrawn and each aliquot added to a mixture of cracked distilled water ice and distilled water (100 grams) and glacial acetic acid (15 mls). Potassium iodide (0.05 grams) is added and the mixture is immediately titrated with 0.01 Molar sodium thiosulphate solution using an iodine indicator ('Iotect' available from British Drug Houses Limited) to the first end point (blue/black—colourless). Precursors which require a titre of greater than 2 mls of 0.01 M sodium thiosulphate are preferred materials for the purposes of the present invention.

EXAMPLE 1

250 grs of tetra acetyl ethylene diamine, 165 grs of technical grade stearic acid and 165 grs of behenic acid were mixed together and heated to 65° C. to form a uniform dispersion. This was passed through a Premier Colloid Mill set to operate at a slow speed with a clearance of 0.0005", and the dispersion was then held in an agitated tank at 70° C.

250 grs of Dobanol (RTM) 45E7 (a substantially linear $C_{14}$–$C_{15}$ primary alcohol condensed with an average of 7 ethylene oxide groups per mole of alcohol), 60 grs of Polyethylene glycol 6000 and 100 grs of a petroleum wax identified as Veba Wachs SP1044 available from Veba-Chemie AG West Germany were liquified in a separate agitated vessel, to which 100 grs of $C_{12}$–$C_{15}$ alkyl dimethyl hydroxyethyl ammonium bromide, 25 grs of ethylene diamine tetra methylene phosphonic acid, 15 grs of sodium salt of methyl vinyl ether maleic anhydride copolymer of MWt approximately 240,000 and 5.0 grs of an optical brightener were added to form a uniform dispersion. This was also passed through a Premier Colloid Mill having the same setting as described above and the resultant dispersion was then added to the first dispersion and thoroughly mixed therewith.

The substrate was in the form of a length of nonwoven apertured material of 12" width disposed on a reel. The substrate material comprised a poly ester wood pulp available from Chicopee Mfg Co., Milltown New Jersey USA, and identified as SK 650 WFX 577, having a basis weight of 50 grs/sq meter (corresponding to 3.8 grs per sheet of 120 sq ins. area) and which contained approximately 80 apertures per sq ins.

The heated dispersion was fed to a trough located over the upper of two heated counter rotating rolls mounted one above the other, the trough and the nip clearance being adjusted to produce an even coating of dispersion on the lower roll, which was operated at a lower temperature than the upper roll to assist the transfer of dispersion at the nip.

The substrate was drawn off the reel over feed rolls and past the lower heated roll in contact therewith, the rotation of the heated rolls being arranged such that the direction of movement of the coated roll surface and the substrate were opposed to each other. The consequent wiping action impregnated the substrate and the uniformity of the substrate loading was enhanced by passage over further heated rolls arranged to contact each side of the substrate. The impregnated substrate was then solidified in a current of air before being stored on a product reel and subsequently cut into sheets of approximately 120 sq ins area.

The loading of the substrate was adjusted to provide on each sheet

| | |
|---|---|
| 5.0 grs | TAED |
| 5.0 grs | Dobanol 45E7 |
| 1.2 grs | Polyethylene glycol 6000 |
| 2.0 grs | $C_{12}$–$C_{15}$ alkyl dimethyl hydroxyethyl ammonium bromide |
| 0.5 grs | Ethylene diamine tetra methylene phosphonic acid |
| 0.3 grs | Sodium salt of methyl vinyl ether-maleic anhydride copolymer MWt 240,000 |
| 0.1 grs | Optical brightener |
| 3.1 grs | Stearic acid |
| 3.1 grs | Behenic acid |
| 2.0 grs | Veba Wax |
| 22.3 grs | |

Sheets made up as desribed above had a pleasant waxy feel, a low tendency to pick up moisture on storage and when used with a conventional anionic surfactant-based perborate-containing laundry detergent provided enhanced removal of both grease and oil and oxidisable fabric stains.

EXAMPLE II

The procedure of Example I was followed using $C_{12}$–$C_{14}$ alkyl methyl dihydroxyethyl ammonium methosulphate as the quaternary ammonium surfactant. The resulting sheets had acceptable feel and hygroscopicity characteristics.

EXAMPLE III

The procedure of Example I was followed except that the cationic surfactant was $C_{12.5}$ alkyl dimethyl hydroxy propyl ammonium triborate. Sheets having acceptable feel and stain removal performance characteristics were producted.

EXAMPLE IV

The general procedure of Example I was used with the following exceptions.

A first dispersion comprised:

| | |
|---|---|
| 250 grs | TAED |
| 65 grs | Stearic acid |
| 165 grs | Behenic acid. |

A second dispersion comprised:

| | |
|---|---|
| 60 grs | PEG 6000 |
| 100 grs | Veba Wax SP 1044 |
| 15 grs | Sodium salt of vinyl methyl ether maleic anhydride copolymer |
| 25 grs | Ethylene diamine tetra methylene phosphonic acid |
| 5 grs | Optical brightener |
| 420 grs | of a 40.5% solution of $C_{1.25}$ alkyl dimethyl hydroxyethyl ammonium stearate in Dobanol 45E7* |

*Made in accordance with the process described hereinbefore and the subject of our copending British Patent application No. 8989/78 filed March 7th 1978, and entitled 'Process for making Detergent Compositions'.

Sheets made from the combination of the two dispersions contained:

| | |
|---|---|
| 5.0 grs | Dobanol 45E7 |
| 5.0 grs | TAED |
| 1.3 grs | Stearic acid |
| 3.1 grs | Behenic acid |
| 1.2 grs | PEG 6000 |
| 2.0 grs | Veba Wax |
| 0.3 grs | Vinyl methyl ether maleic anhydride copolymer |
| 0.5 grs | EDTMP |
| 0.1 grs | Optical brightener |
| 3.4 grs | $C_{12.5}$ alkyl dimethyl hydroxyethyl ammonium stearate |

and had a smooth waxy feel and a reduced tendency to pick up moisture on storage. When used with a conventional laundry detergent containing anionic surfactant and sodium perborate bleach enhanced removal of a range of greasy oily stains and oxidisable stains were noted.

EXAMPLE V

The following compositions are made up in accordance with the procedure of Example I.

-continued

| | 5 | 6 | 7 | 8 | 9 | 10 | 11 |
|---|---|---|---|---|---|---|---|
| TAED | 5.0 | 5.0 | 5.0 | 5.0 | | | 5.0 |
| TAMD | | | | | 5.0 | | |
| AOBS | | | | | | 5.0 | |
| $C_{15}$DMHEAB | 2.0 | | | 2.0 | | | |
| CMDHEAMS | | 2.0 | | | | 2.0 | |
| $C_{12}$–$C_{14}$ DMHEAS | | | 3.5 | | 3.5 | | 3.5 |
| $TAE_{25}$ | | | | | | 5.0 | |
| $C_{14-15}$ $E_{15}$ | 5.0 | | | 5.0 | | | |
| $C_{14-15}$ $E_7$ | | | 5.0 | | | | 5.0 |
| S-$C_{11-15}$ $E_9$ | | 5.0 | | | 5.0 | | |
| EDTMP | 0.5 | 0.5 | | 0.5 | | 0.5 | |
| DETPMP | | | 0.5 | | 0.5 | | 0.5 |
| VME-MA (MWt 240,000) | 0.3 | 0.2 | 0.2 | 0.2 | | 0.2 | 0.2 |
| PEG 6000 | 1.5 | | 1.0 | 1.5 | | | 1.0 |
| PEG 10,000 | | 1.5 | | | 1.0 | | |
| $C_{18}$FA | 3.0 | 3.0 | 6.0 | 3.0 | 6.0 | 6.0 | 6.0 |
| $C_{22}$FA | 3.0 | 3.0 | | 3.0 | | | |
| Wax | 2.0 | 2.0 | | 2.0 | | | |
| 85-15 | | | 0.2 | | 0.2 | 0.2 | 0.2 |
| OWA | 0.1 | 0.1 | 0.1 | 0.1 | 0.1 | 0.1 | 0.1 |
| Substrate 1 | / | / | / | | | / | / |
| Substrate 2 | | | | / | / | | |

In these compositions, the components are identified by the following abbreviations:

TAED—Tetra acetyl ethylene diamine
TAMD—Tetra acetyl methylene diamine
AOBS—Sodium O-acetoxy benzene sulphonate
$C_{14}$ DMHEAB—$C_{14}$ alkyl dimethyl hydroxyethyl ammonium bromide
CMDHEAMS—Middle cut coconut alkyl methyl dihydroxyethyl ammonium methosulphate
$C_{12}$–$C_{14}$ DMHEAS $C_{12}$–$C_{14}$ alkyl dimethyl hydroxyethyl ammonium stearate
$TAE_{25}$—Tallow alcohol ($E_{25}$)
$C_{14-15}$ $E_{15}$—$C_{14}$–$C_{15}$ primary alcohol ($E_{15}$)
$C_{14-15}$ $E_7$—$C_{14}$–$C_{15}$ primary alcohol ($E_7$)
S-$C_{11-15}$ $E_9$—$C_{11}$–$C_{15}$ secondary alcohol ($E_9$)
EDTMP—Ethylene diamine tetra methylene phosphonic acid
DETPMP—Diethylene triamine penta methylene phosphonic acid
VE-MA—Vinyl methyl ether maleic anhydride copolymer (Sodium salt)
PEG 6000—Polyethylene glycol 6000
PEG 10,000—Polyethylene glycol 10,000
$C_{18}$FA—Stearic acid
$C_{22}$FA—Behenic acid
Wax—Microcrystalline Wax
85-15—85/15 Silico-silicone blend (available from Dow Corning)
OWA—Optical whitening agent
Substrate 1—Non-woven apertured sheet of 100% non bleached rayon fibre bonded with ethyl acrylate binder (70% fibre 30% binder) Basis Wt 40 grs/sq meter)
Substrate 2—Non-woven apertured sheet of polyester wood pulp mixture bonded with ethyl acrylate binder (70% fibre 30% binder) Basis Wt 50 grs/sq meter.

We claim:

1. A laundry additive product adapted for the removal of stains and consisting essentially of (a) a substrate comprising a non-particulate solid article in the form of a sheet, block, ring, ball, rod or tube, said article possessing sufficient structural integrity under wash conditions to be recovered substantially intact at the end of the laundry cycle, in water releasable combination with, (b) an organic peroxy compound precursor selected from the group consisting of imides, acyl hydrazides, acylated oximes, anhydrides, and esters wherein the weight ratio of the precursor to the substrate lies in the range from 30:1 to 1:10, and (c) a surfactant system comprising an alkoxylated nonionic surfactant having an HLB in the range 8.0–17.0 and a cationic surfactant having the empirical formula:

$R_m{}^1R_x{}^2Y_LZ$ wherein $R^1$ is a hydrophobic organic group containing alkyl chains optionally including aryl groups and which may also contain ether linkages, ester linkages, or amide linkages, and containing a total of from 8 to 20 carbon atoms, m is a number from one to three, and no more than one $R^1$ can have more than 16 carbon atoms when m is 2 or more than 12 carbon atoms when m is 3, $R^2$ is a substituted or unsubstituted alkyl group containing from one to four carbon atoms or a benzyl group, provided that not more than one such benzyl group is directly attached to each Y group, x is a number from zero to three, the remainder of any carbon atom positions being filled by hydrogens, Y is selected from the group consisting of (1)

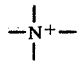

(2)

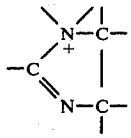

(3)

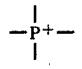

(4)

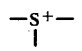

L is a number from 1 to 4, Z is a water-soluble anion in a number to give electrical neutrality, the cationic surfactant being water dispersible in admixture with the nonionic surfactant, the weight ratio of the nonionic surfactant to the cationic surfactant being in the range 20:1 to 1:2, the weight ratio of the surfactant system to the substrate being in the range 20:1 to 1:5.

2. A laundry additive product according to claim 1 wherein the alkoxylated nonionic surfactant is a $C_{10}$–$C_{18}$ linear or branched chain alcohol ethoxylate.

3. A laundry additive product according to claim 2 wherein the nonionic surfactant is a primary $C_{10}$–$C_{15}$ substantially linear alcohol ethoxylate containing from seven to fifteen ethylene oxide groups per alcohol group.

4. A laundry additive product according to claim 3 wherein the weight ratio of nonionic surfactant to cationic surfactant is within the range 10:1 to 1:1.

5. A laundry additive product according to claim 4 wherein the weight ratio of nonionic surfactant to cationic surfactant is within the range 5:1 to 3:2.

6. A laundry additive product according to claim 4 wherein the weight ratio of the surfactant system to the substrate is within the range 10:1 to 1:2.

7. A laundry additive product according to claim 6 wherein the weight ratio of the surfactant system to the substrate is within the range of 8:1 to 1:1.

8. A laundry additive product according to claim 7 wherein the weight ratio of the precursor to the substrate lies in the range 8:1 to 1:4.

9. A laundry additive product according to claim 8 wherein the weight ratio of the precursor to the substrate lies in the range 5:1 to 1:2.

10. A laundry additive product adapted for the removal of stains and consisting essentially of (a) a substrate comprising a non-particulate solid article in the form of a sheet, block, ring, ball, rod or tube, said article possessing sufficient structural integrity under wash conditions to be recovered substantially intact at the end of the laundry cycle, in water releasable combination with, (b) an organic peroxy compound precursor selected from the group consisting of imides, acyl hydrazides, acylated oximes, anhydrides, and esters wherein the weight ratio of the precursor to the substrate lies in the range 8:1 to 1:4 and (c) a surfactant system comprising an alkoxylated nonionic surfactant having an HLB in the range 8.0–17.0 and a cationic surfactant having the emperical formula:

$R_m{}^1R^2{}_xY_LZ$ wherein $R^1$ is a hydrophobic organic group containing alkyl chains optionally including aryl groups and which may also contain other linkages, ester linkages, or amide linkages, and containing a total of from 8 to 20 carbon atoms, m is a number from one to three, and no more than one $R^1$ can have more than 16 carbon atoms when m is 2 or more than 12 carbon atoms when m is 3, $R^2$ is a substituted or unsubstituted alkyl group containing from one to four carbon atoms or a benzyl group, provided that not more than one such benzyl group is directly attached to each Y group, X is a number from zero to three, the remainder of any carbon atom positions being filled by hydrogens, Y is selected from the group consisting of (1)

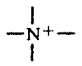

(2)

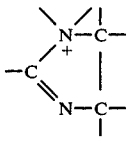

(3)

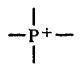

(4)

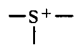

L is a number from 1 to 4, Z is a water-soluble anion in a number to give electrical neutrality, the cationic surfactant being water dispersible in admixture with the nonionic surfactant, the weight ratio of the nonionic surfactant to the cationic surfactant being in the range 20:1 to 1:2, the weight ratio of the surfactant system to the substrate being in the range 20:1 to 1:5.

11. A laundry additive product according to claim 10 wherein the cationic surfactant is such that it has the structure (1), L is 1, $R^1$ is selected from $C_{10}$–$C_{20}$ alkyl and $C_{10}$–$C_{15}$ alkylbenzyl, m is 1 or 2, $R_2$ is selected from $—CH_2C_6H_5$, $—CH_3$, $—CH_2CH_2OH$ and $—CH_2CHOHCH_3$, x is 2 or 3 and Z is a halide, methosulphate, sulphate or carboxylate.

12. A laundry additive product according to claim 11 further comprising detergent components selected from the group consisting of surfactants other than those specified in (c) of claim 1, suds modifiers, chelating agents, softeners, anti-static agents, anti-redeposition and soil suspending agents, optical brighteners, perfumes, enzymes and mixtures of the foregoing, the weight ratio of the precursor to the detergent components being in the range from 500:1 to 10:1.

13. A laundry additive product according to claim 11 wherein the weight ratio of nonionic surfactant to cationic surfactant is within the range 10:1 to 1:1.

14. A laundry additive product according to claim 13 wherein the weight ratio of nonionic surfactant to cationic is within the range 5:1 to 3:2.

15. A laundry additive product according to claim 12 wherein the amount of the detergent component or components is such that the total component:substrate weight ratio is less than 10:1.

16. A laundry additive product according to claim 15 wherein the chelating agent is selected from the group consisting of ethylene diamine tetramethylene phosphonic acid, nitrilo trimethylene phosphonic acid, diethylene triamino pentamethylene phosphonic acid and alkali metal or ammonium salts thereof.

17. A laundry additive product according to claim 15 incorporating as an adjuvant, a suds modifier selected from $C_{20}$–$C_{24}$ fatty acids, copolymers of ethylene oxide with a hydrophobic group formed by condensing propylene oxide with propylene glycol, polydialkyl siloxanes and mixtures thereof with silica, microcrystalline waxes, triazine derivatives and mixtures of any of the foregoing.

18. A laundry additive product according to claim 17 including as adjuvant $C_{16}$–$C_{18}$ fatty acid.

19. A laundry additive product according to claim 18 wherein the weight ratio of the nonionic-cationic surfactant mixture to the $C_{16}$–$C_{18}$ fatty acid is in the range 1:5 to 4:1.

20. A laundry additive product according to claim 19 wherein the weight ratio of the nonionic-cationic surfactant mixture to the $C_{16}$–$C_{18}$ fatty acid is in the range 1:3 to 3:2.

21. A laundry additive product adapted for the removal of stains and consisting essentially of (a) a substrate in flexible sheet form in water releasable combination with (b) an organic peroxy compound precursor selected from tetraacyl $C_2$–$C_6$ alkylene diamines wherein the weight ratio of the precursor to the substrate lies in the range from 5:1 to 1:2 and (c) a surfactant system comprising a nonionic surfactant selected from primary $C_{10}$–$C_{15}$ substantially linear ethoxylates containing from about seven to about 15 ethylene oxide groups per alcohol group and a cationic surfactant of formula $R_1(R^2)_3N^+Z$ wherein $R_1$ is selected from $C_{10}$–$C_{20}$ alkyl and $C_{10}$–$C_{15}$ alkyl benzyl, $R_2$ is selected from $—CH_2C_6H_5$, $—CH_3$, $—CH_2CH_2OH$, and $—CH_2CHOHCH_3$, provided that not more than one $R_2$ group is $—CH_2C_6H_5$ and Z is selected from halide, methosulphate, sulphate and carboxylate, the cationic surfactant being water dispersible in admixture with the nonionic surfactant, the weight ratio of the nonionic surfactant to the cationic surfactant being in the range 5:1 to 3:2 and the weight ratio of the surfactant system to the substrate being in the range 8:1 to 1:1.

22. A laundry additive product according to claim 21 further comprising an organic adjuvant selected from organic chelating agents, suds modifiers, anti redeposition agents and optical brighteners, and mixtures of the foregoing, the amount of such adjuvants being such that the total adjuvant:substrate weight ratio is less than 10:1.

* * * * *